US005189398A

United States Patent [19]

Mizutani

[11] Patent Number: 5,189,398

[45] Date of Patent: Feb. 23, 1993

[54] FLAME DETECTING AND ALARMING SYSTEM WITH ULTRAVIOLET SENSOR

[75] Inventor: Noboru Mizutani, Isesaki, Japan

[73] Assignee: Tokyo Parts Industrial Co., Ltd., Isesaki, Japan

[21] Appl. No.: 710,706

[22] Filed: Jun. 5, 1991

[30] Foreign Application Priority Data

Jun. 11, 1990 [JP] Japan ..... 2-152352

[51] Int. Cl.[5] ..... G08B 17/12

[52] U.S. Cl. ..... 340/578; 250/372

[58] Field of Search ..... 340/577-578, 340/584, 309.15, 825.64; 250/372

[56] References Cited

U.S. PATENT DOCUMENTS 4,016,424 4/1977 Traina ..... 250/372
4,247,848 1/1981 Kitta et al. ..... 340/584
4,328,527 5/1982 Landis ..... 340/578 X
4,455,487 6/1984 Wendt ..... 250/372 X
4,736,105 4/1988 Fonnesbeck ..... 250/372
4,975,683 12/1990 Parsons et al. ..... 340/578
4,988,884 1/1991 Dunbar et al. ..... 340/578 X

*Primary Examiner*—Jin F. Ng
*Assistant Examiner*—Thomas J. Mullen, Jr.
*Attorney, Agent, or Firm*—Hidaka and Benman

[57] ABSTRACT

A flame detecting and alarm system has a ultraviolet radiation sensor (UV sensor) which detects ultraviolet radiation and outputs sensor output pulses. The spacings of the sensor output pulses represent amounts of energy of the ultraviolet radiation detected by the UV sensor. Each pulse spacing of the sensor output pulses is measured, and the pulses are regarded as "continuous" if the pulse spacings are less than a predetermined time period. The presence of a predetermined number of "continuous" sensor output pulses is interpreted as a recognition of a flame, and an alarm is activated.

3 Claims, 3 Drawing Sheets

FLAME DETECTING AND ALARMING SYSTEM WITH ULTRAVIOLET SENSOR

BACKGROUND OF THE INVENTION

1. Field of the Invention

This invention relates to a flame detecting and alarming system with a ultraviolet sensor. The system detects an ultraviolet radiation from a flame, which may be of matches, a lighter, a burner, a fire, or any flammable object, and generates an alarming sound. The system is typically used for a fire alarm system.

2. Description of the Prior Art

There have been various kinds of fire alarm systems in the market. Among them is a system that detects ultraviolet rays radiated from a flame and triggers an alarming sound.

However many of the conventional fire alarming systems have some of the following disadvantages:

(1) The horizontal and vertical fire-detectable angles as viewed from the detector are too narrow. The fire-detectable distance is too short. Some systems can detect a fire within only a few meter range. Some systems can detect a fire not in its initial stage but only after the fire has developed to a critical stage.

(2) Some systems are operable only on an AC power. Therefore, the systems can not be used where no commercial power is available. The requirement for a power-supply transformer makes the system bulky and heavy and, thus, the locations where the systems can be installed have to be limited.

(3) An alarm sound does not reach distant places.

(4) An alarm sound is too weak to be heard where a high-level background noise is present.

SUMMARY OF THE INVENTION

In view of the above, an object of the present invention is to provide a flame detecting and alarming system which can be operable even where no commercial power is available.

Another object of the present invention is to provide a flame detecting and alarming system which is light, compact, simple in construction, inexpensive, and can be installed at almost any desired places.

A further object of the present invention is to provide a flame detecting and alarming system whose alarm sound can be heard even at distant locations from the system or fire site or locations where high-level background noise is present.

In order to achieve the above objects, the flame detecting and alarm system of the present invention employs a ultraviolet (UV) radiation sensor (i.e. a UV sensor). The system further includes a power source battery, a voltage regulator, a DC-DC converter which boosts the output of the voltage regulator to an operating voltage for the UV sensor, an R-C circuit to form a square pulse signal from the output of the UV sensor, and a flame recognition circuit to determine whether the pulse signals output from the UV sensor derive from a UV radiation from a flame or a UV radiation from a radiation source other than a flame. The system further includes an alarm signal transmitter and an alarm driver which activate a horn or buzzer in response to an output signal of the flame recognition circuit.

All of the above elements are enclosed in a case. The case has a window through which UV radiations reach the UV sensor. An extension terminal is attached to the output of the alarm driver so that one or more external alarm horns or buzzers can be placed away from the main system and connected to the main system through the terminal. Therefore, the alarm can also be recognized from locations away from the main system. A volume control is provided in the case so as to adjust the level of the alarming sound to a desirable level depending on the environmental condition or the background noise of the site.

The construction of the flame detecting and alarming system is simple because the battery, the UV sensor, the primary horn or buzzer, and all of the circuits are packaged in a case. False alarm can be prevented because the flame recognition circuit can distinguish the output signal of the UV sensor between one deriving from a UV radiation of a flame and another deriving from a UV radiation of an object other than a flame.

FIGS. *5a–5e* shows various signals which particularly explain the function of the flame recognition circuit of the system.

DETAILED DESCRIPTION OF THE PREFERRED EMBODIMENT

Figure 1:
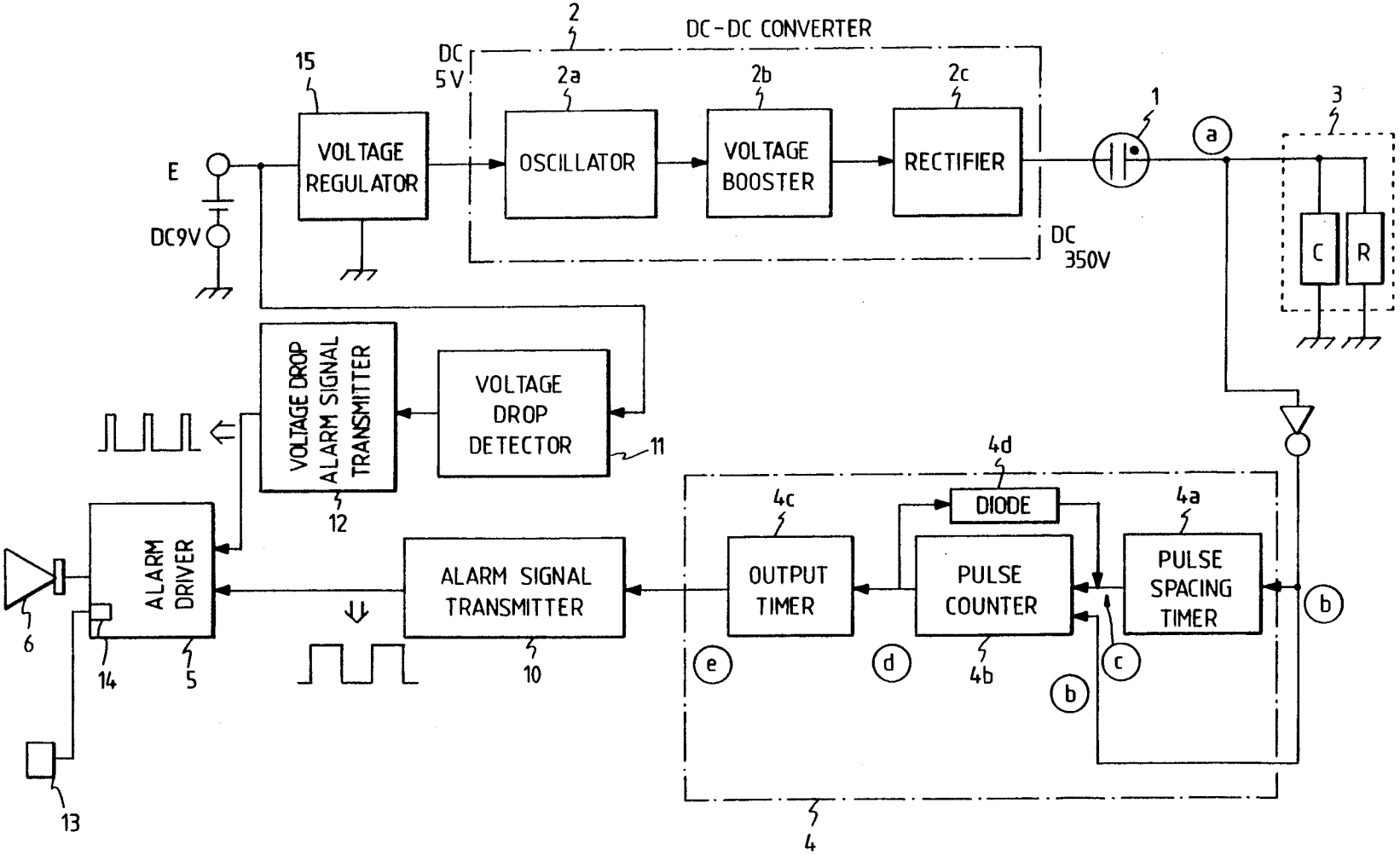
FIG. 1 shows a block diagram of a flame detecting and alarming system of one embodiment according to the present invention.

FIG. 1 shows a block diagram of a flame detecting and alarming system of one embodiment according to the present invention.

In FIG. 1, letter E denotes a power source battery which has a 9-volt output in this embodiment. Numeral 15 denotes a conventional-type voltage regulator which outputs a regulated 5-volt DC, in this embodiment, regardless of a drop or fluctuation of the battery voltage resulting from a discharge or environmental factors.

Numeral 2 denotes a DC-DC converter and numeral 1 denotes a UV sensor (i.e. a ultraviolet radiation sensor). The DC-DC converter 2 boosts the output voltage of the voltage regulator 15 to an operating DC voltage of typically 350 V for the UV sensor 1. The operating voltage may practically be within an approximate range of 300 V to 400 V DC. Since the amount of the current required for the DC-DC converter 2 substantially affects the life of the battery E, the DC-DC converter 2 should preferably be of a type which requires as little amount of current as possible. The DC-DC converter 2 consists of an oscillator *2a*, which generates an oscillating differential signal and converts the signal to square pulses; a voltage booster *2b*, which generates trigger pulses in response to the square pulses and boosts the voltage of the trigger pulses to the operating voltage of the UV sensor 1; and a rectifier *2c*, which rectifies the boosted trigger pulses.

The UV sensor 1 activates itself upon detecting UV radiation and outputs a sensor output signal, which is identified as "(a) signal 51" in FIGS. 1 and *5a*. One of the UV sensors usable for this embodiment is "UVtron- R2868" which is a registered trade name of Hamamatsu Photonics Co., LTd., Japan.

Figures 5A, 5B, 5C, 5D, 5E:
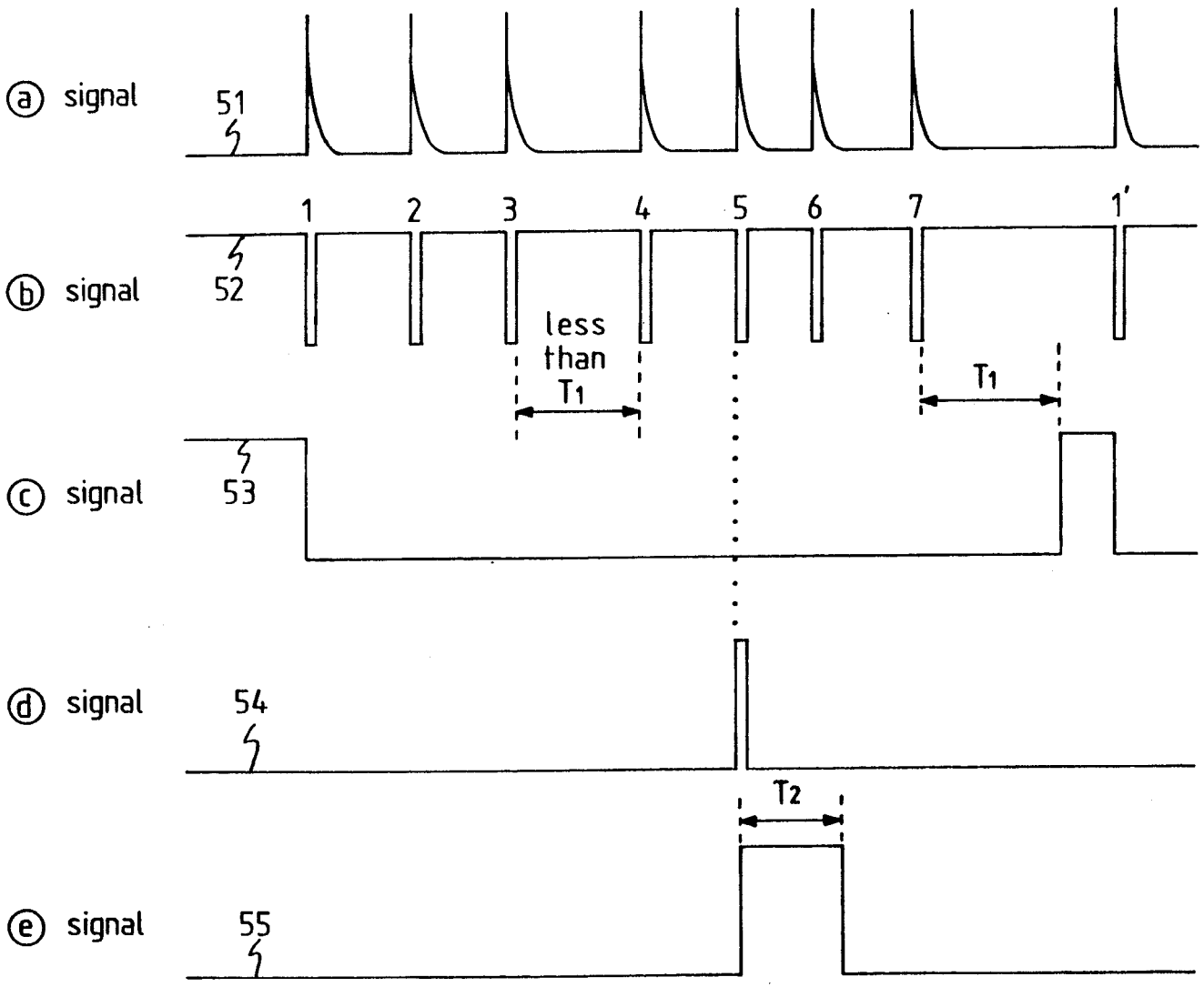

The UV sensor 1 detects ultraviolet radiations having a wavelength spectrum of typically 185 to 260 nanometers. Because the strata surrounding the earth absorb substantial parts of the solar UV rays, the smallest wavelength boundary of the wavelength spectrum of the solar UV rays reaching the earth is about 200 nanometers. On the other hand, the wavelength spectrum of the UV rays radiated from various kinds of flames on the earth generally falls within the range of 185 to 260 nanometers. In addition, the UV sensor will naturally be installed not to be subjected to direct sunlight or strong indirect sunlight. Therefore, the UV sensor 1 detects more UV radiation from flames than normally existing indirect solar UV radiation. The sensor output signal ((a) signal 51) of the UV sensor 1 is normally a train of pulses as shown in FIG. 5*a* and the pulse spacings thereof represent the amounts of energy of the ultraviolet radiations detected by said UV sensor 1. The greater the amount of UV radiation energy received by the UV sensor 1, the shorter the pulse spacings. In other words, a reception of greater amount of UV radiation causes the pulses to be output more frequently.

Numeral 3 denotes an R-C circuit to transform the output signal ((a) signal) from the UV sensor 1 to a square pulse signal, which is identified as "(b) signal 52" in FIGS. 1 and 5*b*.

Numeral 4 demotes a flame recognition circuit. The flame recognition circuit 4 recognizes and determines whether the pulse signals output from the UV sensor 1 derive from a UV radiation of a flame or from a UV radiation of a source other than a flame. Namely, the flame recognition circuit 4 recognizes a ultraviolet radiation of a flame received by the UV sensor 1 by examining the output pulses of the UV sensor 1. Upon determining that the UV sensor 1 has received a ultraviolet radiation of a flame, the flame recognition circuit 4 outputs an alarm control signal, which is identified as "(e) signal 55" in FIGS. 1 and 5*c*.

Referring to FIGS. 1 and 5*b*, the flame recognition circuit 4 includes a pulse-spacing timer 4*a*, a pulse counter 4*b*, an output timer 4*c* and a diode 4*d*. The pulse-spacing timer 4*a* is preset for a predetermined time period (T1) and time the pulse spacings of the incoming (b) signal 52 in reference to the predetermined time (T1). If a pulse spacing between one pulse and the succeeding pulse of the (b) signal 52, timed by the pulse-spacing timer 4*a*, is within the predetermined time period (T1), the two pulses are regarded as "continuous". In other words, as long as all of the pulse spacings of successive pulses of the (b) signal 52 are less than T1, the successive pulses of the (b) signal 52 are regarded as "continuous". Conversely, if a pulse spacing between a pair of successive pulses of the (b) signal 52 is T1 or more, the corresponding successive pulses are regarded as "non-continuous". A pulse train of the (b) signal 52 is "discontinued" when T1 has lapsed after any pulse of the (b) signal 52. In this embodiment, the predetermined time period (T1) is set for 4 seconds. However, the predetermined time period (T1) may be set within a range of 2 to 4 (or 4−2 to 4+0) seconds.

Referring to FIGS. 1, 5*b* and 5*c*, the output signal from the pulse-spacing timer 4*a* outputs a signal identified as "(c) signal 53", whose signal form is shown in FIG. 5*c*. The (c) signal 53 is normally HIGH, which is a stand-by state, before no (b) signal 52 has entered to the pulse-spacing timer 4*a*. When the first pulse of the (b) signal enters to the pulse-spacing timer 4*a*, the (c) signal becomes LOW. The pulse-spacing timer 4*a* measures the pulse-spacing between each successive pair of the (b) signal pulses, and determines whether or not each measured pulse spacing is less than the predetermined time period (T1). If a measured pulse spacing is less than the predetermined time period (T1), the corresponding two successive pulses are regarded as "continuous" and the pulse-spacing timer 4*a* keeps measuring the pulse-spacing between the succeeding pair of the (b) signal pulses. The pulse-spacing timer 4*a* continues this measuring sequence as long as the pulse spacings between (b) signal pulses and the respective succeeding pulses are less than the predetermined time period (T1).

If and when the predetermined time period (T1) has lapsed after a (b) signal pulse has input, and before any succeeding (b) signal pulse has input, the output signal of the pulse-spacing timer 4*a* (i.e. (c) signal 53) rises and becomes HIGH. Then, the pulse-spacing timer 4*a* reverts to the stand-by state and waits for the next initial (b) signal pulse to input. Therefore, the rising edge of the (c) signal 53 functions as a reset signal, which is hereinafter referred to as "first reset signal". Upon receiving the next initial (b) signal pulse, the output signal of the pulse-spacing timer 4*a* (i.e. (c) signal 53) becomes LOW and the sequence of measuring the pulse-spacings, as mentioned above, restarts.

The pulse counter 4*b* counts the number of continuous (b) signal pulses as timed and determined as "continuous" by the pulse-spacing timer 4*a*. The (b) signal 52 and the output signal of the pulse-spacing timer 4*a* ((c) signal 53) are input to the pulse counter 4*b*, as shown in FIG. 1. The pulse counter 4*b* starts counting successive (b) signal pulses when the (c) signal 53 received from the pulse-spacing timer 4*a* becomes LOW (i.e. at the falling edge of the (c) signal 53), and maintains the pulse counting as long as the (c) signal 53 is LOW. Since the (b) signal pulses are "continuous" while the (c) signal 53 is LOW, the pulse counter 4*b* counts only continuous (b) signal pulses. Upon having counted a predetermined number (n) of (b) signal pulses, the pulse counter 4*b* outputs the (d) signal 54, which is a single short pulse as shown in FIG. 5*d*. The counting of the predetermined number (n) of continuous (b) signal pulses by the pulse counter 4*b* signifies a recognition of a flame. Therefore, the (d) signal 54 may be regarded as a flame recognition signal.

The (d) signal (i.e. the flame recognition signal) is fed back to the input of the pulse counter 4*b* through a diode 4*d*. The signal fed back from the output of the pulse counter 4*b* to the input thereof is hereinafter referred to as "second reset signal". Upon receiving the second reset signal, the pulse counter 4*b* resets itself and restarts the counting sequence of (b) signal pulses from number one. In other words, the first (b) signal pulse after the second reset signal is input is the No. 1 pulse for the next counting sequence. Then, upon completion of counting of another set of the predetermined number (n) of continuous (b) signal pulses, the pulse counter 4*b* again outputs a (d) signal 54, another flame recognition signal, thereby causing the signal to be fed back to the input of the pulse counter 4*b*. The pulse counter 4*b* repeats the counting cycle as long as the (b) signal pulses are continuous and successively outputs (d) signal pulses at every n number of (b) signal pulses.

In this embodiment, the predetermined number (n) of "continuous" pulses to be counted by the pulse counter 4b so as to output the (d) signal 54 is set for 5. However, the number may alternatively be set for 6 instead of 5.

The output timer 4c, upon receiving the output signal ((d) signal 54) from the pulse counter 4b, outputs a time-regulated alarm control signal, which is identified as "(e) signal 55", whose signal form is shown in FIG. 5c. The duration of the alarm control signal ((e) signal) is set for a predetermined time period (T2) by the output timer 4c. In this embodiment, the predetermined time period (T2) is 3 seconds.

The pulse spacings of the output pulse signal ((a) signal 51) of the UV sensor 1 are comparatively short in the case the output signal ((a) signal 51) results from a ultraviolet radiation from a flame as compared to the case where the output signal ((a) signal 51) results from a ultraviolet radiation from an object other than a flame, such as normally existing indirect sunlight. Whereas, the pulse spacings between the output signal ((a) signal 51) of the UV sensor 1 and the input signal ((b) signal 52) to the flame recognition circuit 4 are equal to each other. Therefore, it is determined that a ultraviolet radiation detected by the UV sensor 1 is resulted from a flame if the input signal ((b) signal 52) to the flame recognition circuit 4 includes at least the predetermined number (n) of continuous pulses whose pulse spacings are less than a predetermined time period (T1) as timed by the pulse-spacing timer 4a. In this case, the flame recognition circuit 4 recognizes a presence of a flame and outputs an alarm control signal ((e) signal 55).

Conversely, it is determined that a ultraviolet radiation detected by the UV sensor 1 is not resulted from a flame if the input signal ((b) signal 52) to the flame recognition circuit 4 includes less than the predetermined number (n) of continuous pulses whose pulse spacings are less than a predetermined time period (T1). In this case, the flame recognition circuit 4 recognizes no presence of flame and outputs no signal.

Referring to FIG. 1, numeral 10 denotes an alarm signal transmitter which outputs an intermittent pulse signal, as shown in FIG. 1, upon receiving the time-regulated alarm control signal ((e) signal 55) from the output timer 4c of the flame recognition circuit 4 and causes an alarm diver 5 to be activated intermittently for the time period (T2) set by the output timer 4c. The alarm driver 5 in turn activates a horn or buzzer 6 according to the intermittent pulse signal received from the alarm signal transmitter 10. Thus, the horn or buzzer 6 produces intermittent alarming sounds. The horn or buzzer 6 may alternatively be a luminous indicator.

Still referring to FIG. 1, numeral 11 denotes a voltage drop detector which detects a drop of the output voltage of the battery E and outputs a voltage drop detection signal. Numeral 12 denotes a voltage drop alarm signal transmitter which transmits an intermittent pulse signal, as shown in FIG. 1, upon receiving the voltage drop detection signal from the voltage drop detector 11, and causes the alarm driver 5 to be activated, resulting in an intermittent sounding of alarm by the horn or buzzer 6, so that the battery E may be recharged or replaced with a new battery before the battery E becomes unserviceable. The pulse width and the pulse spacing of the intermittent pulse signal transmitted from the voltage drop alarm signal transmitter 12 are different from those of the intermittent pulse signal transmitted from the alarm signal transmitter 10 so that the resulting respective alarming sounds can be easily distinguished from each other.

Figure 2:
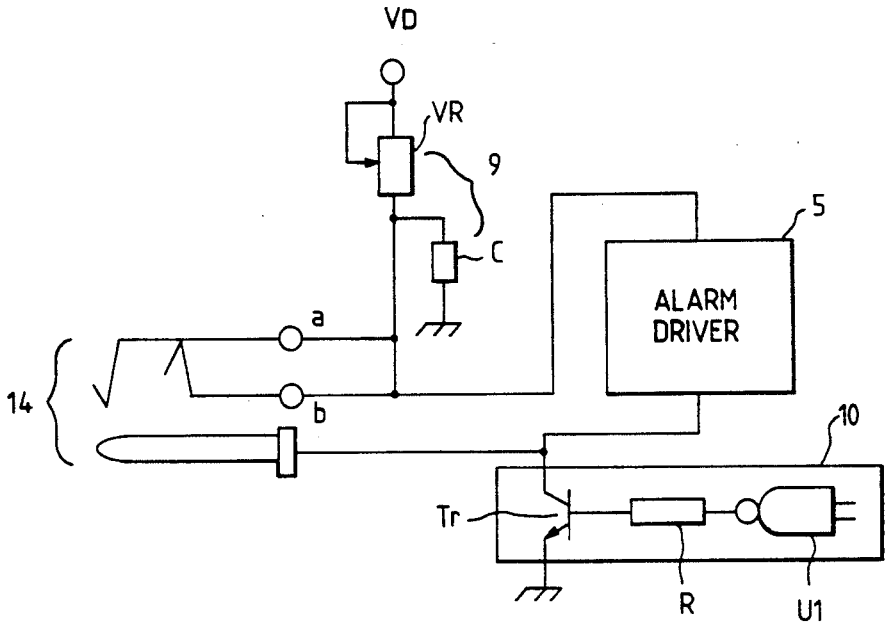
FIG. 2 shows a detail circuit for driving the external horns or buzzers connected to the extension terminal attached to the alarm driver of the system.

Referring to FIGS. 1 and 2, numeral 14 denotes an extension terminal which is attached to the output of the alarm driver 5 so that one or more external alarm horns or buzzers 13 can be placed away from the main system and connected to the main system through the extension terminal 14. Therefore, the alarm can also be recognized from locations away from the main system.

In FIG. 2, numeral 9 denotes a volume control, consisting of a variable resistor VR and an electrolytic capacitor C which are connected in series between the positive output of the battery E and the ground. The alarming sound can be adjusted to a desirable level by the volume control 9.

Figure 3:
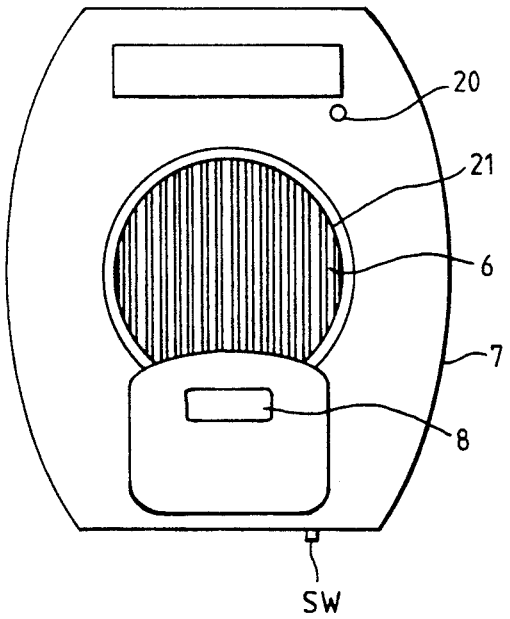
FIG. 3 is a front view of the flame detecting and alarming system.

Referring to FIG. 3, numeral 7 denotes a case containing the flame detecting and alarming system 1. Numeral 20 denotes a luminous indicator attached to the case 7, which is lit whenever the system is powered on and under operational condition. Numeral 21 denotes a latticed opening, inside of which is the horn or buzzer 6 installed so that the alarming sound goes out through the opening 21. Numeral 8 denotes another opening, through which is the UV sensor exposed to the environment. The opening 8 is not covered by glass or any other transparent material so that no element of the ultraviolet radiations to be received by the UV sensor 1 be absorbed by any cover material.

Figure 4:
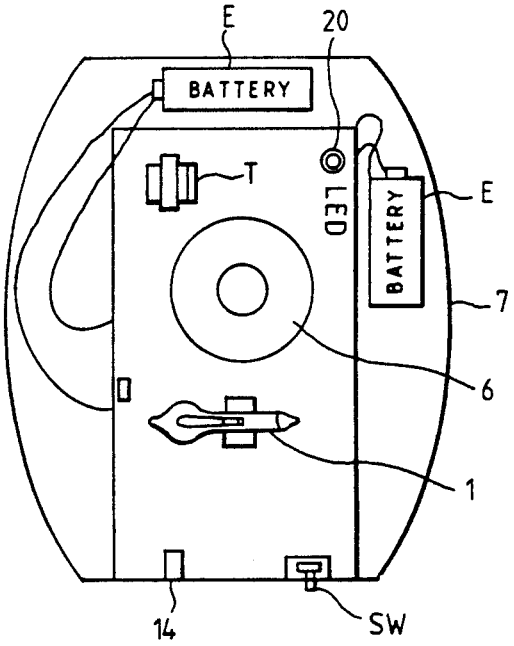
FIG. 4 is a rear view of the system in which the rear case cover is removed.

Referring to FIG. 4, letters SW denote a reset switch which is installed on the bottom of the case 7. After recognizing a valid alarming sound, the alarm can be deactivated by pressing the reset switch SW.

It will be understood that various changes and modifications may be made in the above described embodiments which provide the characteristics of the present invention without departing from the spirit and principle thereof particularly as defined in the following claims.

What is claimed is:

1. A flame detecting and alarm system, comprising:

(a) a ultraviolet radiation sensor (UV sensor) which detects ultraviolet radiation, said UV sensor outputting sensor output pulses having pulse spacings, said pulse spacings representing amounts of energy of the ultraviolet radiation detected by said UV sensor;

(b) means for transforming said sensor output pulses having pulse spacings to second pulses having the same pulse spacings as of said sensor output pulses;

(c) a pulse spacing timer which measures each of the pulse spacings of said second pulses in reference to a predetermined time period and outputs a pulse spacing timer output signal, said pulse-spacing timer output signal maintaining a first signal level after any of said second pulses has entered said pulse-spacing timer and as long as the measured pulse spacings of successive second pulses are within said predetermined time period but shifting to a second signal level when said predetermined time period has elapsed after any of said second pulses has entered said pulse-spacing timer without an input of a succeeding pulse;

(d) a pulse counter for counting a number of said second pulses which are "continuous", the term "continuous" signifying that the pulse spacings of said second pulses are less than said predetermined time period, said pulse counter outputting a flame recognition signal when the number of "continuous" second pulses counted has reached a predetermined number;

(e) an output timer for outputting a time-regulated alarm signal in response to said flame recognition signal;

(f) an alarming device;

(g) an alarm driver to activate said alarming device in response to said alarm signal; and (h) a power supply means for providing said UV sensor with operational DC power therefor.

2. A flame detecting and alarm system according to claim 1, wherein said predetermined time period is within the range from 2 seconds to 4 seconds.

3. A flame detecting and alarm system according to claim 1, wherein said predetermined number is 5 to 6.

* * * * *